US006587780B2

(12) United States Patent
Trovato

(10) Patent No.: US 6,587,780 B2
(45) Date of Patent: Jul. 1, 2003

(54) SYSTEM AND METHOD FOR DISSEMINATING TRAFFIC INFORMATION

(75) Inventor: Karen I. Trovato, Putnam Valley, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 117 days.

(21) Appl. No.: 09/829,116

(22) Filed: Apr. 9, 2001

(65) Prior Publication Data

US 2002/0147541 A1 Oct. 10, 2002

(51) Int. Cl.[7] ..... G06G 7/76
(52) U.S. Cl. ..... 701/117; 701/202; 342/357.13
(58) Field of Search ..... 701/117, 118, 701/119, 202, 208; 342/357.09, 357.1, 357.13; 340/901, 905, 988

(56) References Cited

U.S. PATENT DOCUMENTS

| | | | | |
|---|---|---|---|---|
| 5,131,020 A | | 7/1992 | Liebesny et al. | 379/59 |
| 5,164,904 A | | 11/1992 | Sumner | 364/436 |
| 5,313,200 A | | 5/1994 | Sone | 340/905 |
| 6,023,232 A | | 2/2000 | Eitzenberger | 340/988 |
| 6,087,953 A | | 7/2000 | Deline et al. | 340/815.4 |
| 6,209,026 B1 | | 3/2001 | Ran et al. | 709/218 |
| 6,292,743 B1 | * | 9/2001 | Pu et al. | 701/202 |

FOREIGN PATENT DOCUMENTS

| | | | |
|---|---|---|---|
| DE | 19651143 A | 6/1998 | G08G/1/0962 |
| EP | 1069405 A2 | 1/2001 | G01C/21/34 |
| WO | WO0022593 | 4/2000 | G08G/1/0969 |
| WO | WO0050844 | 8/2000 | G01C/21/26 |

* cited by examiner

*Primary Examiner*—Yonel Beaulieu
(74) *Attorney, Agent, or Firm*—John Vodopia

(57) ABSTRACT

Automatic personal advisories relating to traffic conditions are provided at pre-specified times via avenues of communication specified by the users. Use is made of a map database to generate routes and various types of advisories. Traffic conditions may be evaluated by comparing current speed data against nominal speed data.

25 Claims, 6 Drawing Sheets

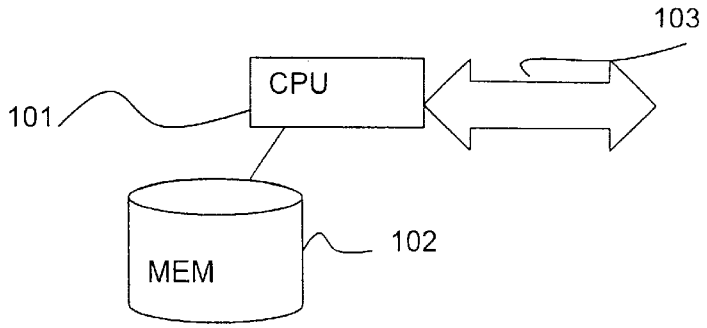
FIG. 1
FIG. 3
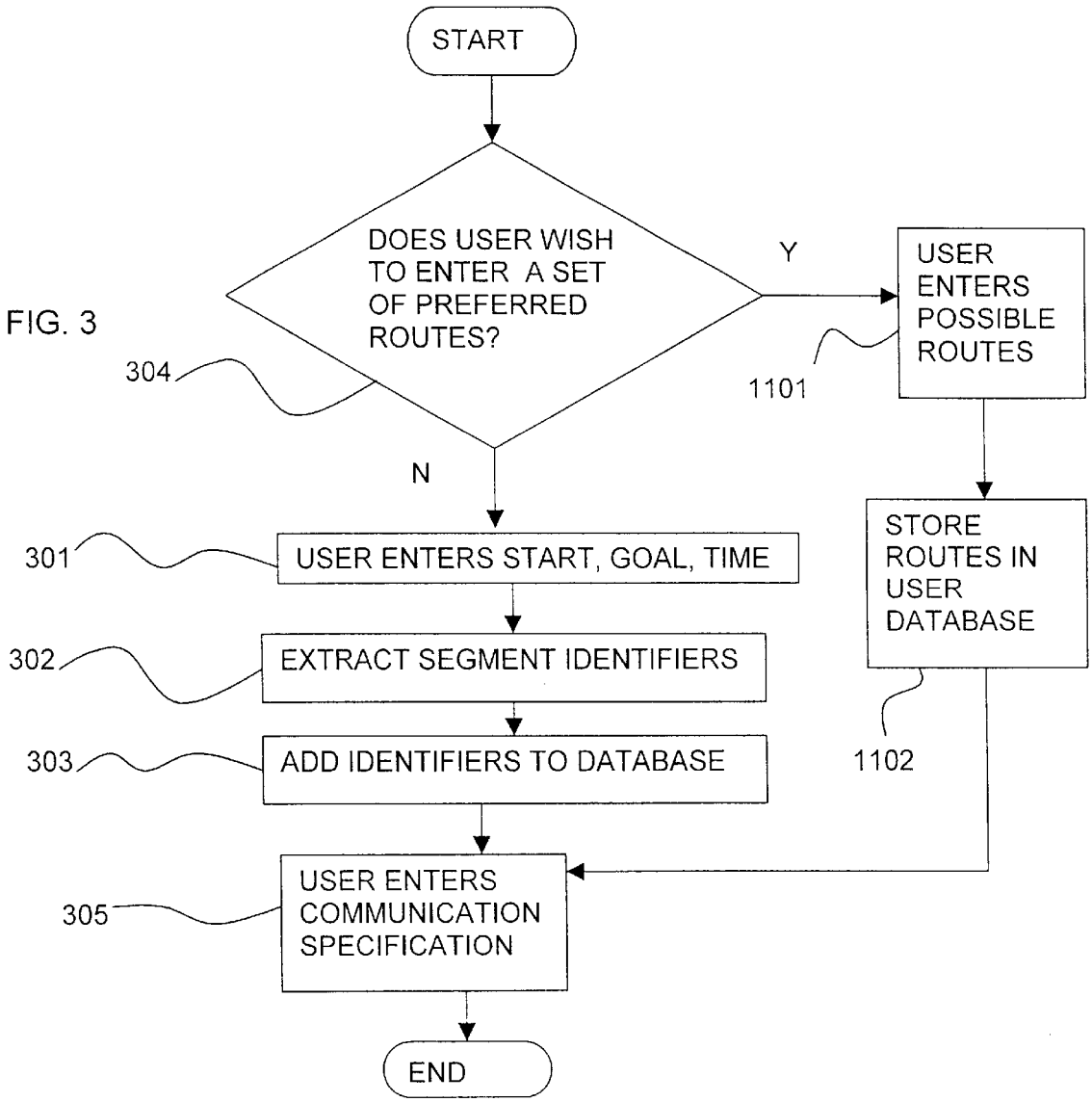

START

CREATE TRIP DATA
201
205
IDENTIFY TRIP DATA CORRESPONDING TO A CURRENT TIME
202
CHECK TRAFFIC DATA AGAINST TRIP DATA TO FIND PROBLEMS
WHEN PROBLEM FOUND, COMMUNICATE WITH APPROPRIATE USER
203
204
Y
N
NEW TRIP DATA NEEDED?

| LINK IDENTIFIER | CRITICAL TIME IDENTIFIER | COMMUNICATION AVENUE IDENTIFIER | COMMUNICA-TION ADDRESS | ADVISORY TYPE |
|---|---|---|---|---|
| 401 | 402 | 403 | 404 | 405 |

FIG. 4

Fig. 5

```
Select USER_DB.LINK_IDENTIFIER, PROBLEM_DB.DESCRIPTION,
            COMMUNICATION AVENUE IDENTIFIER, COMMUNICATION ADDRESS
   from PROBLEM_DB, USER_DB
   where PROBLEM_DB.LINK_IDENTIFIER eq USER_DB.LINK_IDENTIFIER
   and RELEVANT_START_TIME < CURRENT_TIME
   and CURRENT_TIME < RELEVANT_END_TIME
```

Fig. 6

```
If $COMMUNICATION_AVENUE_IDENTIFIER eq 'email'
email $USER_DB.COMMUNICATION_ADDRESS
-msg "Traffic Problem: $    PROBLEM_DB.DESCRIPTION
on $PROBLEM_DB.LINK"
```

FIG. 7

| LINK IDENTIFIER | DESCRIPTION | CURRENT SPEED |
|---|---|---|
| 701 | 702 | 703 |

Fig. 8

```
Select PROBLEM.LINK_IDENTIFIER, PROBLEM.DESCRIPTION, COMMUNICATION
        AVENUE IDENTIFIER, COMMUNICATION ADDRESS, START, END
From PROBLEM, USER, MASTER
Where PROBLEM.LINK_IDENTIFIER eq USER.LINK_IDENTIFIER
And PROBLEM_DB.LINK_IDENTIFIER eq MASTER_DB.LINK_IDENTIFIER
And RELEVANT_START_TIME < CURRENT_TIME
And CURRENT_TIME < RELEVANT_END_TIME
Sort by COMMUNICATION_ADDRESS then by PROBLEM.LINK_IDENTIFIER
```

Fig. 9

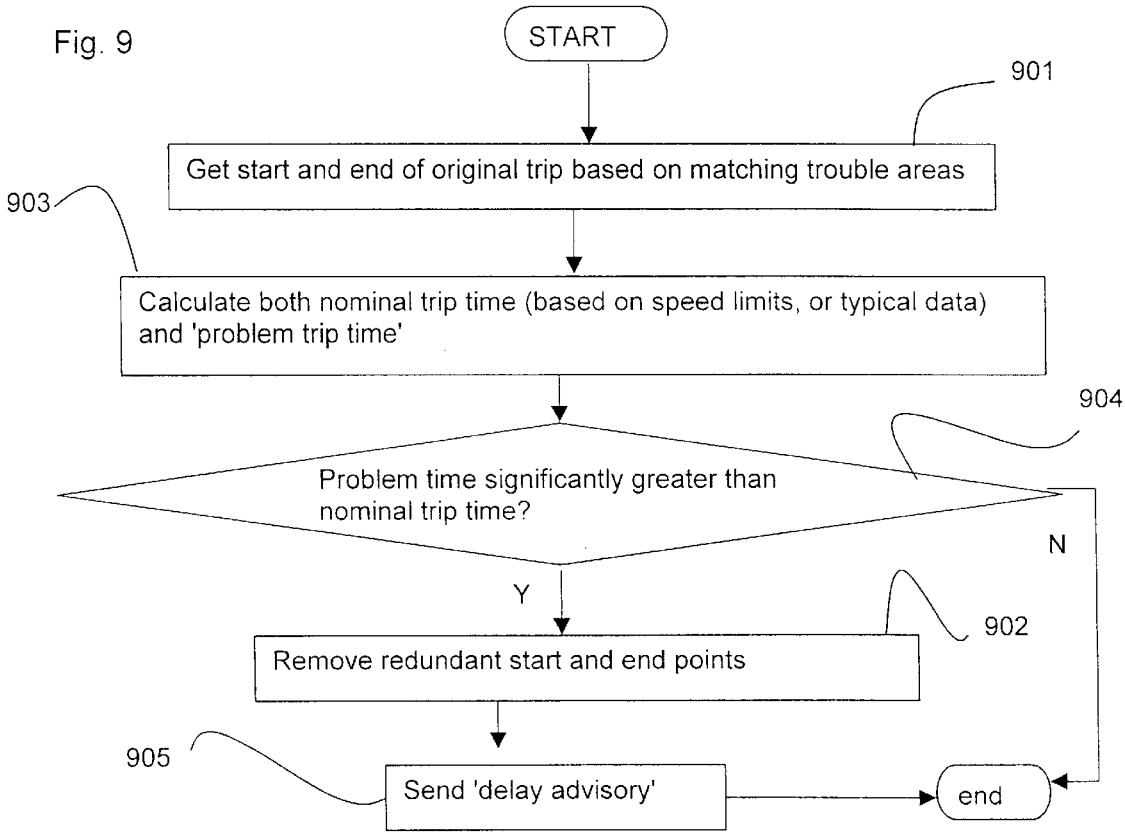

| start | Via-list | End (trip options) | Communication time | Communication mode | Communication address |
|---|---|---|---|---|---|

1201 1202 1203 1204 1205 1206

SYSTEM AND METHOD FOR DISSEMINATING TRAFFIC INFORMATION

BACKGROUND OF THE INVENTION

1. Field of the Invention

The invention relates to the field of dissemination of information relating to vehicular traffic.

2. Related Art

Some traffic information is available via broadcast, e.g. via radio or TV. Information delivered by this medium is not always available at the desired time. The user must typically wait until the station or channel is ready to announce the information. Also, the user is at the mercy of the data selection preferences of the broadcaster. The broadcaster is limited by the time availability and the expected preferences of the majority of listeners or viewers. These limitations may not allow transmission of the data relevant to a particular user. Also, by the time the information is broadcast, it may be inaccurate.

Drivers can get supplementary traffic conditions via various other media, such as the Internet or calling traffic information numbers; however, the user must take the initiative before travelling which is often unrealistic and wastes the user's time.

Some information is available in databases maintained by organizations who monitor traffic in urban areas. These may be private organizations that collect government data and information from other sources such as CB radio users and specially positioned traffic watchers. These organizations format traffic data so it is suitable for redistribution to the media. These traffic data, especially those that report abnormal traffic conditions will be referred to here in as "problems." An example of such a private organization is "Shadow Traffic"

Traffic information from government organizations may come from sensors embedded in roadways.

WO 00/22593 describes an in-car technique for updating route planning using speed of current traffic and presenting it to a user. There are several difficulties with in-car systems. First they are relatively expensive. Second the necessary radio transmissions to deliver real-time traffic problems are not yet available in the U.S. Third, these systems are only useful once the driver is in the car, and has entered his destination. Generally, the driver will only do this on infrequent trips, e.g. non-commuter trips, or once he or she is already stuck in traffic. Traffic jams cause the user and society to lose time and money, add pollution and generate stress. Once the user is already in traffic, it is already too late to prevent adding to the jam.

SUMMARY OF THE INVENTION

It is an object of the invention to improve existing traffic alert systems.

This object is achieved by automatically alerting a user of situations regarding conditions of travel relating to user trip data. The user is alerted using a communication specification desired by the user.

Further objects and advantages will be apparent in the following.

BRIEF DESCRIPTION OF THE DRAWING

The invention will now be described by way of non-limiting example with reference to the following drawings.

FIG. 1 shows a system for use with the invention.

FIG. 3 is an expansion of box 202 of FIG. 2.

FIG. 4 shows a record format for use in a user database.

FIG. 5 shows code for effecting box 202 of FIG. 2.

FIG. 6 shows code for effecting an e-mail message to a user.

FIG. 7 shows a record format for use in a problem database.

FIG. 8 shows code for effecting box 901 of FIG. 9.

FIG. 9 shows a flow chart for effecting a delay advisory.

FIG. 11 shows a flow chart for providing preferred route information.

DETAILED DESCRIPTION OF THE PREFERRED EMBODIMENTS

Figure 2:
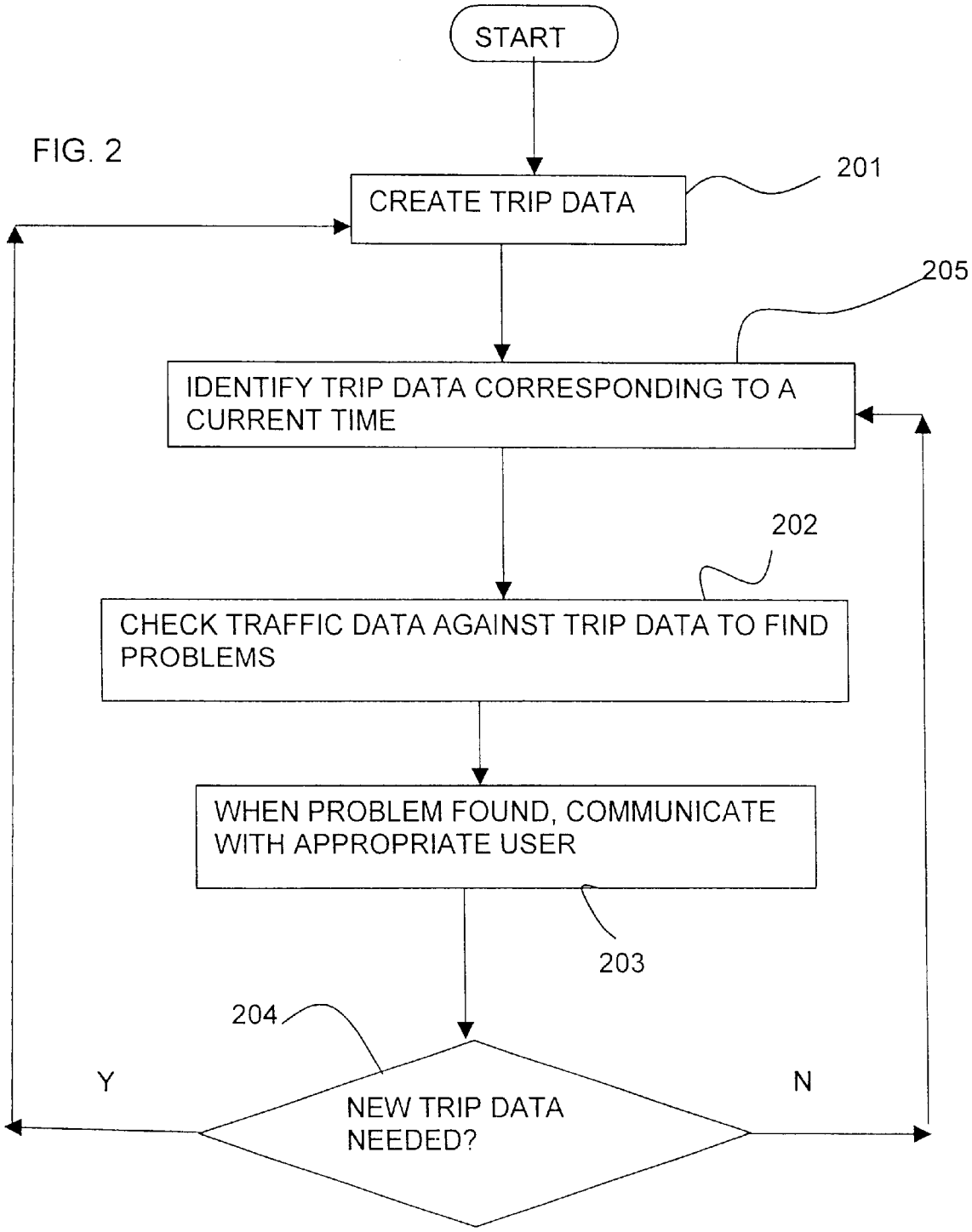
FIG. 2 shows a flowchart describing aspects of the invention.

Problem: traffic service information about specific abnormal road events including: accident, blockage (construction, animals, trees, people), weather (ice, fog, etc.), speed, and/or congestion. Problems are usually reported for specific road names or locations. Problems can also be detected simply by observations of reduced speed on a segment of roadway, with a blockage being indicated by a speed of zero. The speed can be calculated by 'loop detectors'; image analysis of video; 'probe cars' that store and report their current speed through an area, or other means. An example of a system for gathering 'real time' data, as well as more accurate 'nominal' data,—by the use of probe cars—is described in U.S. Pat. No. 5,539,645, entitled "Traffic Monitoring System with Reduced Communications Requirements", issued to Mandhyan and Trovato on Jul. 23, 1996. An example of the use of 'nominal' data alone can be found in the Navigation Technologies data base used by the URL mapquest.com, which makes use of the speed limits along road segments to calculate expected travel times and produce driving directions. By contrast the improved 'nominal' data of the '645 patent, makes nominal data dependent on time, e.g., time of day or day of week, based on historical observations. Alternately, problems can be input via text or graphical input, possibly in response to phoned in data.

General Advisory: generated when a problem for a road name or location matches a user's link identifiers. Link identifiers will be explained further below.

Link: is used to mean a directed edge that is part of a representation internal to a data processing device. The link corresponds to one direction of a "road segment". The road segment may normally have one or two directions; though possibly some road segments might have extra links. Within the stored representation of the map, the links are used to plan routes. The road segments corresponding to links are usually between two intersections or exit/entrance ramps, though such segments may correspond to multiple links.

Delay Advisory: Provides an estimate of the delay incurred as a result of problem user links that impact speed such that they cause an overall trip delay of more than M minutes or P percent of typical travel. M and P are variables that may be set by the user or the system may use defaults such as M=10 minutes, P=30%.

Alternate Route Advisory: If there is a delay advisory, the problem user links may be temporarily removed from the navigation search to force identification of the 'next best' route. An example of a navigation search that gives Alternate Route Advisories is the Carin System, described at the URL carin.com, and provided by VDO Dayton, which receives European real-time traffic data via the RDS FM sub-carrier.

Preferred Route Advisory: When the user gives N typical routes for the same commute time, the system will report either the best or the estimated time for each.

FIG. 1 shows a computer system on which the invention may be implemented. The system may be local to a user, or may be a central service system. Typically, there will be both types, with most of the functions relating to the invention being executed on the central service system. The system includes a CPU 101 and a memory 102. The CPU and memory may be of any type. The system may be part of a PC, a television, a set top box, or any other data processing system.

There are also connections 103 to peripherals, which may include one or more displays, speakers, printers, modems, pointer devices, keyboards, network connections, remote control devices, microphones for voice recognition, cameras for video data gathering, and so forth. The network connection will typically be to the Internet, though connections to other networks are also possible. Peripherals can also be connected to the system via a network and a remote processor or processors. In addition, processing may be done remotely via a network connection. The connections shown may be wired or wireless. Wireless connections may be radio frequency, infrared, or the like.

FIG. 2 shows a flowchart according to the invention. At 201 trip data is created. Box 201 is expanded in FIG. 3, below.

At 205, pre-registered user trip links corresponding to a current time are identified.

At 202, problems are searched for by comparing traffic data with trip data. For instance, expected speeds for current trip data can be compared to actual speeds. Traffic information must be continuously updated from multiple sources and converted into an internal format representing the speed along each link of roadway. The external information sources will have to be queried on a continuous basis for up to date information relating to links that are of interest.

The service system maintains a database or list of all links that are relevant to customers. A link relevant to a customer may be in the form of the data structure or record shown in FIG. 4, discussed further below.

If traffic information is entered as text, and cannot be easily mapped to internal link identifier format, groups of links might be considered as blocked, such as long sections of a single roadway. For instance, blocked links relating to a single road, such as "Taconic Parkway", may be combined to yield a general advisory such as "3 mile backup Northbound ending at 202."

At 203, if a problem with the stored route has been identified, the user should be contacted. More about problems will be explained below with respect to FIG. 7.

The user's route contains information that identifies the links used in that user's typical route. A database system such as MySQL or Oracle can extract user links that match the problem location and where the start and end times bracket the current time. A user may request to receive advisories of the types General Advisory, Delay Advisory, Alternate Route and/or Preferred Route. One of the flow charts of FIGS. 9, 10, and 11 may be triggered responsive to a user-specified advisory type, prior to initiating communication via a user-specified communication avenue. More about how this may be done will be discussed with respect to FIG. 4.

At 204, it is tested whether new trip data needs to be generated. This might be due to a new user signing on, an existing user entering additional trips, or an existing user wanting to modify a stored trip. FIG. 3 is an expansion of box 201.

At 304, it is tested whether the user wishes to enter a set of preferred routes. If so, control passes to boxes 1101 and 1102, which will be discussed further with reference to FIG. 11 relating to preferred route advisories. If the user does not wish to enter preferred routes, control passes to box 301.

At 301 the user enters start and goal points and desired time of travel. This information is also stored in a 'master database' (not shown).

The start and goal points might be entered verbally, textually, or graphically. They may be an address, point of interest—such as hotel, airport, etc.—or a phone number that maps to an address.

The desired time might be in the form of a start time for travel for the first link. Alternatively, the user could give a range of times during which he or she desires to have the route checked. Still a third alternative would be to have the user give a desired start time for travel, and have the system infer some default time interval before, after, or around the start time during which to conduct checks for problems. Another alternative would be for the user to enter a desired arrival time and then have the system calculate a necessary start time for the trip, and start conducting checks for problems in the user's trip links with respect to the calculated start time.

Advantageously, the system can allow the user to include, in the time to be checked, a day of the week when the trip is to be undertaken. In other words, the system would check that day every week on a repeating basis. The day of the week might be expressed generically, such as "weekday/weekend" or individually, such as "Saturday". Alternatively, the day might be expressed as a day of the month, such as first Tuesday; as a calendar date; or as a known holiday, such as Christmas.

Those of ordinary skill in the art might devise any number of ways to specify time.

Optionally, the user may also specify what types of advisories he or she wishes to receive and for which specific trips that type is desired.

At 302 relevant link identifiers are extracted from the map database, which may be constructed in accordance with the prior art map databases discussed elsewhere herein. The link identifiers are also added to the master database. The relevant link identifiers may be extracted in accordance with the A* algorithm, which is used to plan the path between the start and goal points, based on a criterion. More about A* can be found in U.S. Pat. No. 4,949,277; and U.S. Pat. No. 5,808,887.

Currently, on the Internet, there is a website corresponding to the URL mapquest.com, which is an example of how route planning may be done automatically, using A*. The system provides driving instructions from a start point to a goal point entered by the user. These instructions are chosen to optimize the path based on a criterion. The criterion for optimization is travel time. The travel time is estimated based on a heuristic, i.e. length of road segments and speed limits on those links.

The common heuristic of minimizing time of travel based on speed limit suffers from the drawback that the posted speed limit on a road segment is not necessarily the actual speed on that link. There may be traffic or weather conditions that result in slower traffic; and there may be places where traffic is known to go in excess of the speed limit. However, from the point of view of identifying links to use in creating a trip database, this heuristic is sufficient to generate 'typical', good directions. The trip can then be modified using current traffic information as needed.

Alternate criteria for route planning are available to create the links in the trip database, also known as user database herein. These alternate criteria include 'use the fewest freeways', which handicaps the sue of certain classified roads; 'shortest distance', which does not use speed but only the length of road; or 'avoid steep hills', which might be particularly advantageous for large trucks.

The route planning is effected by generating a list of links along the route.

Alternatively, the user might enter an expected route manually, according to his or her preferences. More about this will appear below in the discussion of preferred routes.

Those of ordinary skill in the art can devise other techniques for extracting relevant link identifiers, whether from user entered information or from some form of route search.

At 303, the identifiers are added to the user database.

At 305, communication specification or specifications are entered. This may include the desired avenues of communication and desired advisory types, both of which will be discussed further below. The communication specification may be stored as a single specification for an entire trip; or separate communication specifications may be stored for each link of a trip.

User Database Record Format

Herein, master database, a user (or trip) database and a problem database are described. These can be maintained as separate databases; but the different format records can also be kept as a single database. Similarly, there may be several databases, whether of the master, problem or user type, or combination types. One of ordinary skill in the art might also devise ways of combining the map database with any or all of the other types of data. The various databases may be stored in the same memory or in different memories. The different memories may be accessible via a network such as the internet.

FIG. 4 shows a user database record format. The format includes

- a link identifier 401 (also called USER_DB.LINK_IDENTIFIER, in the SQL statement of FIG. 5);
- a critical time identifier or identifiers 402 (also called RELEVANT_START_TIME and RELEVANT_END_TIME, above);
- a communication avenue identifier or identifiers 403;
- a communication address or addresses 404, such as a phone number or e-mail address; and
- at least one desired advisory type 405.

The link identifiers 401 may be stored in the system in any number of ways, such as in the form of link numbers or actual road names. For improved precision, the link identifier 401 may include the latitude and longitude of the endpoints of corresponding road segment, as is done in the Navigation Technologies database, see the website corresponding to the URL navtech.com. Use of a road name is an easier system to implement, because only a text match is necessary to associate records in the user and problem data bases; but use of road names alone can result in loss of precision. For example, when the user enters a route only by road name without cross roads or end points, then a problem anywhere on the roadway may produce an advisory. Preferably, in both the user and problem database, the link identifier 401 is the 'key' field.

The critical time identifier 402 indicates when this part of the route is to be checked and may include any of start time, end time, range of times, and so forth, as explained above with respect to box 301. Optionally there may be two times listed in the record. The first time would be a time when the link should be checked prior to the user's expected departure and the second time would be one when the user is expected to be in a vehicle approaching the link.

The communication avenue identifier 403, will indicate how to reach a user. For instance, the user might elect to receive an e-mail, a telephone call, a fax, a beeper call, or any other suitable type of contact. The type of contact may be made time dependent. Each link may specify a different communication avenue for problems encountered relating to that link.

If more than one time is listed at 402, then a second set of fields relating to communication mode and communication address may also be needed. For example, prior to departure, the user may want to be contacted on the home or office telephone, while en route the user may want to be contacted via the cell phone.

The advisory type field 405 will trigger generation of an advisory type, discussed further below. More than one advisory type may be specified for each communication time; and/or different communication times may be linked with different advisory types.

All data originally entered by the user, including original start and goal locations used to generate the links stored according to the record format of FIG. 4, will need to be stored in a master database (not shown), or a master record or table within the user database. The start and goal need to be retained in case new links need to be generated, for instance in the case of an alternate route. The start and goal are also needed to test if a problem affects the full route significantly (described later). The master also contains a list of link identifiers so that for each problem, the starts and goals for affected trips can be determined. The list of link identifiers will be particularly useful in the case of a delay advisory, explained further below.

Problem Database Record Format

A 'problem' is detected by comparing the list of problems reported by traffic companies or government agencies and the list of links and times supplied by all users of the traffic alert system. The problem may be stored in a 'problem database', having a record format such as that shown in FIG. 7, i.e. including a link identifier 701, a description 702, and a current speed 703. The link identifier field must use the same references as the link identifier field in the user database in order to be effective. The description field 702 is optional, but helpful, in explaining the type of problem to be found in the link described. The current speed field 703 indicates the speed of traffic on the corresponding link. This current speed is used instead of the typical speed for calculating delay, but may also be reported in an advisory.

Generating Advisories

While the advisories are generally described herein as being generated in response to a user specification, those of ordinary skill in the art might equally well devise a system that decides for itself what type of advisory to issue to a user. For instance, if a link is found to be blocked, e.g. having a speed of <5 M.P.H., an alternative route may be calculated for the user, whether the user requested this or not.

The general advisory is achieved by running the 'select' statement of FIG. 5. The extraction results in the User_db.link problem description, communication identifier, and communication address: e.g.

51540 "Taconic Parkway slowdown 2 miles before 202" email custname@custisp.net

Those of ordinary skill in the art might devise any number of types of messages transmissible to a user as part of a general advisory. FIG. 6 indicates a script style code segment in the PERL language for implementing an e-mail message to a user. In other words, if the communication avenue identifier of the record indicates email, then an email is sent to the communication address of a format such as the following:

From: Traffic Service

To: user@domain.com

Subject: Traffic 4 you

Traffic Problem: 20 minute backup from 202 to Underhill Ave on Taconic State Parkway Possibly the simplest message might be that a particular link is slow or blocked. A more sophisticated message might indicate how extensive the blockage is. If delays can be quantified, such as in the above e-mail, then an automatic re-generation of the route, with real-time speeds on the links may produce the messages "There is a 20 min. backup on your preferred route. We recommend taking route 9 to route 6 to the Taconic State Parkway." In an even worse situation, if an entire region is blocked, and the user needs to go through that region, it might pay for the user not even to leave his or her current location. This might occur during a weather emergency, for instance. Then the message might say, for instance, "Due to the winter storm, all roads in Westchester County are considered unsafe for driving and police have ordered all non-emergency vehicles off the road." However, the system should make all efforts to find a way for the user to travel, and only tell the user not to travel as a last resort.

More than one area of blockage might be identified along a route, for instance two auto accidents in different places. Preferably, all areas of blockages will be listed for the user. This can be done by concatenating the 'problem area messages' into messages intended for the same user at the same time. Thus, 5 problems on the same route aren't sent as a battery of 5 messages, but rather are sent as only one message, albeit lengthy, with one starting message that says: Route delay 45 minutes, with 5 problems reported. Then, they can be enumerated.

In general for the delay advisory, alternate route advisory and preferred route advisory, described below, the map data base should store two speeds for each link: a nominal speed and a current speed. When the times of travel along problem trips are to be calculated for the advisory, the current speed should be used.

The delay advisory can be generated in accordance with the flow chart of FIG. 9. At box 901, original start and goal locations, for a particular general advisory area, are retrieved. This can be done in accordance with the code of FIG. 8, which is in SQL. This code extracts all users, who will pass through the problem link at the current time,—along with the information those users have entered with respect to how they want to be contacted and their starts and goals for their full trips, as found in the master database. The sort at the end of the SQL statement will simplify grouping of communications to a user, rather than sending many messages piecemeal. At 903 nominal and problem trip times are calculated, with the nominal trip time being that one which is normally expected and the problem trip time being the one affected by problem links. If the problem time is significantly greater than the nominal trip time at 904, e.g. 20% greater, then, at 902, redundant start and goal locations are removed and a delay advisory is issued at 905.

Figure 10:
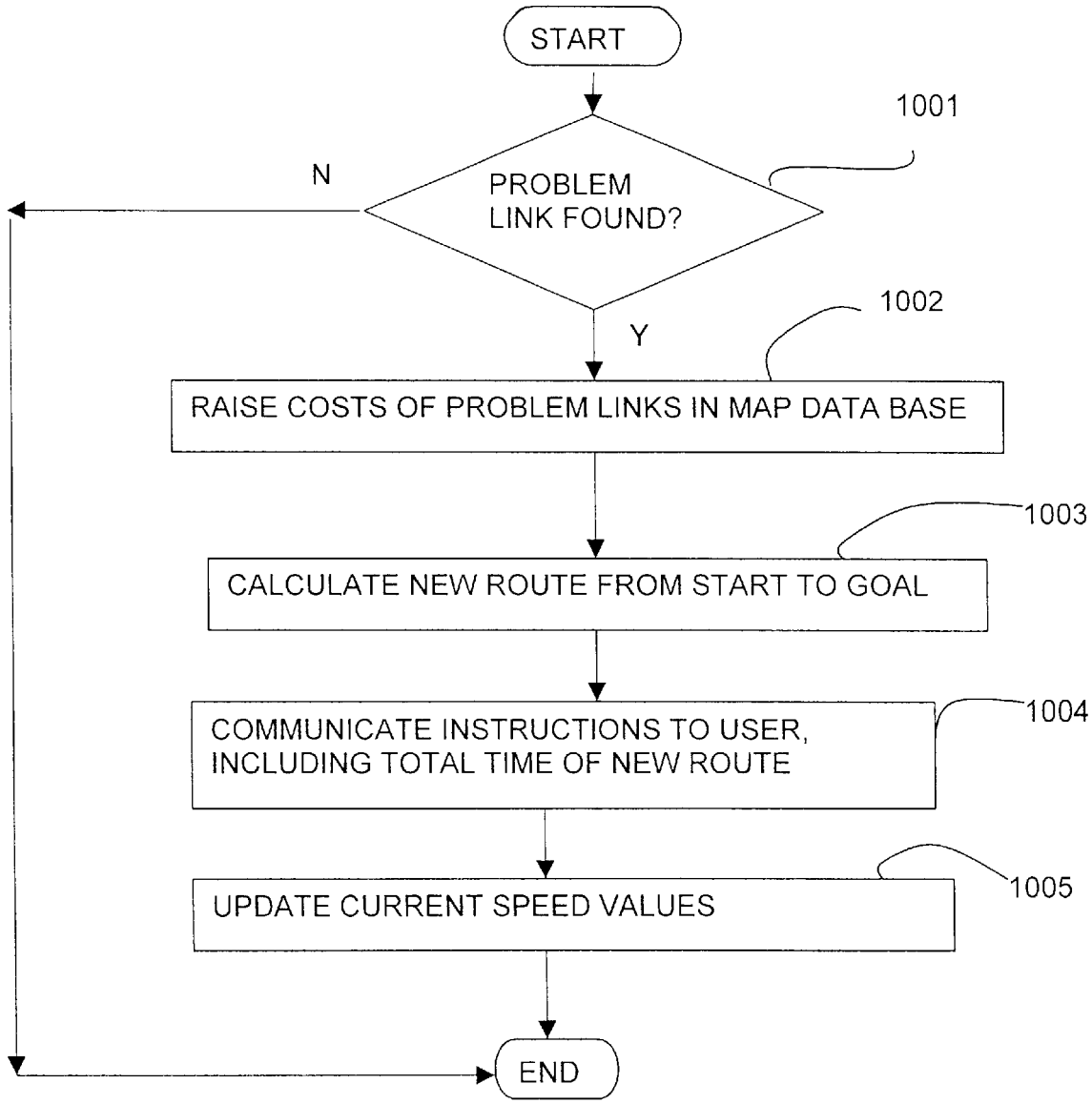
FIG. 10 shows a flow chart for providing alternate route information.

FIG. 10 shows a flow chart for the provision of alternate route information for the user. At 1001, it is tested whether a problem link has been found, e.g. in the determination of a Delay Advisory. If a problem link or links have been found, then at 1002 the costs of such links must be raised in the map database. For instance the cost may be raised to a high travel-time value, as the speed approaches zero, assuming minimum time calculation as the criterion for optimization. Then a new route from start to goal is calculated at 1003 and new route information is communicated to the user at 1004. The value of the 'current speed', will be updated at 1005 as the values are changed, either from the data collection system or manually.

FIG. 11 shows a flow chart for the provision of preferred route information for the user. Two of the boxes relating to preferred routes are shown in FIG. 3. These are boxes 1101 and 1102. At 1101, the user enters possible routes called a 'user set'. The 'user set' should include at least 2 possible routes, each possible route being set of separate route options, typically beginning with the same start and terminating with the same goal, but having different intermediate points along the route.

Figure 12:
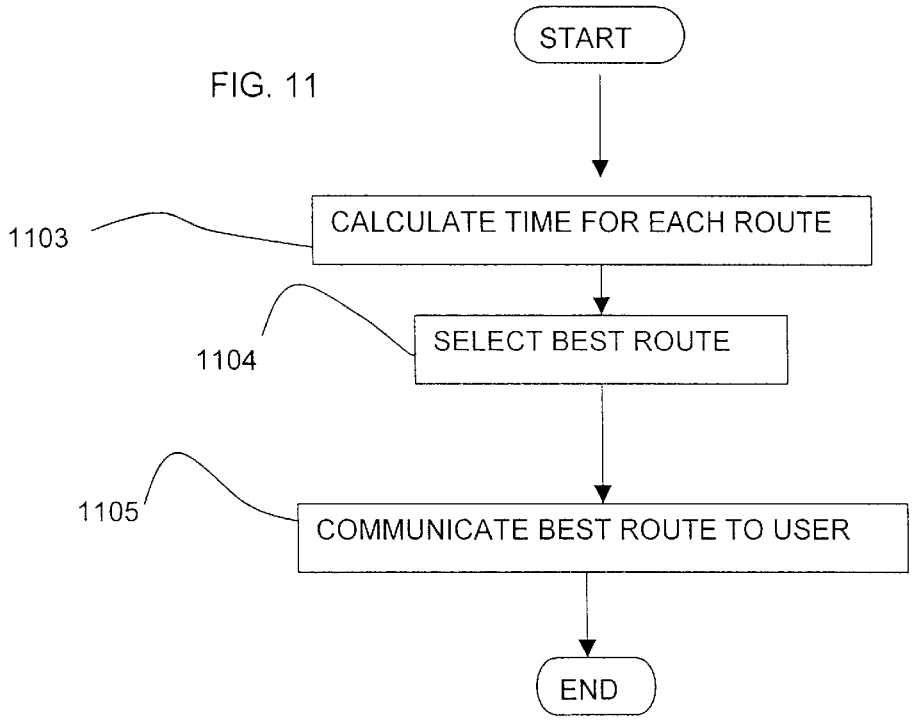

Entry of the 'user set' may, for instance, be done interactively using points and clicks to identify segments or points on a map or by identifying 'via' points or roads textually. These are locations that must be visited along the way. Thus a person may enter start point A, via Bridgel, and goal point B. The second route is start point A, via Bridge 2, and goal point B. The calculation is really two sub-trips concatenated. That is, a calculation from point A to Bridge 1 produces one sub-path, and Bridgel to goal point B produces another sub-path. These are connected to create the full path via Bridge 1. The second path (via Bridge 2) is calculated similarly. The path thus has not only a start and goal, but also 'via' points, in the particular order given by the user. The route then needs to be converted into internal link identifier format. The possible routes are stored in the user database 1102. Records of different format from FIG. 4 will be required for this storage, because intermediate points need to be identified. FIG. 12 shows an example of the record format required including fields for start 1201; the via-list 1202—which will point to a list of link identifiers—; the goal 1203; a communication time 1204, a communication mode 1205, a communication address 1206; and a title for the trip option 1207. Preferably, the user will give each trip-option a name, such as 'via Washington bridge' or 'via Tappan Zee'.

Then the time for each route is calculated at 1103. This will involve computing each path from the start, through the vialist, to the goal. When calculating the "actual" current traveltime from start to goal, current data is used rather than the nominal data.

The best route is selected in box 104. This will typically be the least-time route, but other routes may be sent instead, such as the shortest route, or the least-freeways route for people who prefer to travel more slowly or through towns. Then the best route is communicated to the user 1105. The message can take the format:

email: username@userisp.com subject: via Tappan Zee

"We recommend that you travel using your trip-option:

Via Tappan Zee. Travel time: 55 minutes."

From reading the present disclosure, other modifications will be apparent to persons skilled in the art. Such modifications may involve other features that are already known in the design, manufacture and use of systems to provide traffic information and driving instructions and that may be used instead of or in addition to features already described herein. Although claims have been formulated in this application to particular combinations of features, it should be understood that the scope of the disclosure of the present application also includes any novel feature or novel combination of features disclosed herein either explicitly or implicitly or any generalization thereof, whether or not it mitigates any or all of the same technical problems as does the present invention. The applicants hereby give notice that new claims may be formulated to such features during the prosecution of the present application or any further application derived therefrom.

The word "comprising", "comprise", or "comprises" as used herein should not be viewed as excluding additional elements. The singular article "a" or "an" as used herein should not be viewed as excluding a plurality of elements.

What is claimed is:

1. A method for disseminating traffic information to users, comprising the steps of:

maintaining at least one database comprising;

a plurality of trip description structures;

information regarding conditions of travel associated with at least one of the trip description structures in view of current information;

respective trip data corresponding to at least one trip for each of a plurality of users, the trip data being communicated by the plurality of users and including, for each user:

at least one geographic identification, at least one critical time selected from the group consisting of a start time for the at least one trip, an arrival time for the at least one trip, a desired start time for the at least one trip, and a day of the week when the at least one trip is to be undertaken, and at least one communication specification selected by that user, processing the trip data, at a predetermined time relative to the critical time and responsive to the conditions of travel, to identify at least one situation relating to the trip data; and contacting at least one user at a second time relative to the critical time, responsive to the situation and in accordance with the communication specification.

2. The method of claim 1, wherein contacting a user further comprises communicating at least one user-specified advisory type via at least one user-specified avenue of communication.

3. The method of claim 1, wherein communication of the situation includes specifying an alternate or preferred route.

4. The method of claim 1, wherein communication of the situation includes specifying information about a delay.

5. The method of claim 1, wherein the trip data further comprises identification of appropriate ones of the trip description structures; and processing the trip data comprises checking the appropriate ones of the trip description structures against the conditions of travel.

6. The method of claim 1, wherein processing comprises comparing current speed with nominal speed, for appropriate ones of the trip description structures.

7. The method of claim 1, wherein the method is carried out using at least one data processing device.

8. The method of claim 1, wherein the critical time is stored as a range of times.

9. The method of claim 1, wherein the trip data includes more than one critical time and a respective communication specification for each critical time.

10. A data processing device comprising:

at least one memory for embodying at least one database in a form readable by the data processing device, the database comprising;

a plurality of trip description structures;

information regarding conditions of travel associated with at least one of the trip description structures in view of current information;

respective trip data corresponding to at least one trip for each of a plurality of users, the trip data being communicated by the plurality of users and including, for each user:

at least one geographic identification, at least one critical time selected from the group consisting of a start time for the at least one trip, an arrival time for the at least one trip, a desired start time for the at least one trip, and a day of the week when the at least one trip is to be undertaken, and at least one communication specification selected by that user, at least one processor adapted to perform the following operations processing the trip data, at a predetermined time relative to the critical time and responsive to the conditions of travel, to identify at least one situation relating to the trip data; and causing at least one user to be contacted at a second time relative to the critical time, responsive to the situation and in accordance with the communication specification;

at least one communications portal for effecting contact with users and receiving the information regarding the conditions of travel.

11. The device of claim 10, wherein contact with the user further comprises communicating at least one user-specified advisory type via at least one user-specified avenue of communication.

12. The device of claim 10, wherein communication of the situation includes specifying an alternate or preferred route.

13. The device of claim 10, wherein communication of the situation includes specifying information about a delay.

14. The device of claim 10, wherein the trip data further comprises identification of appropriate ones of the trip description structures; and processing the trip data comprises checking the appropriate ones of the trip description structures against the conditions of travel.

15. The device of claim 10, wherein the processing includes comparing current speed with nominal speed, for appropriate ones of the trip description structures.

16. The device of claim 10, wherein the critical time is stored as a range of times.

17. The device of claim 10, wherein the trip data includes more than one critical time and a respective communication specification for each critical time.

18. A medium, readable by a data processing device and embodying code for carrying out operations, the operations comprising:

maintaining at least one database comprising;

a plurality of trip description structures;

information regarding conditions of travel associated with at least one of the trip description structures in view of current information;

respective trip data corresponding to at least one trip for each of a plurality of users, the trip data being communicated by the plurality of users and including, for each user:

at least one geographic identification, at least one critical time selected from the group consisting of a start time for the at least one trip, an arrival time for the at least one trip, a desired start time for the at least one trip, and a day of the week when the at least one trip is to be undertaken, and at least one communication specification selected by that user, processing the trip data, at a predetermined time relative to the critical time and responsive to the conditions of travel, to identify at least one situation relating to the trip data; and contacting at least one user at a second time relative to the critical time, responsive to the situation and in accordance with the communication specification.

19. The medium of claim 18, wherein contacting a user further comprises communicating at least one user-specified advisory type via at least one user-specified avenue of communication.

20. The medium of claim 18, wherein communication of the situation includes specifying an alternate or preferred route.

21. The medium of claim 18, wherein communication of the situation includes specifying information about a delay.

22. The medium of claim 18, wherein the trip data further comprises identification of appropriate ones of the trip description structures; and processing the trip data comprises checking the appropriate ones of the trip description structures against the conditions of travel.

23. The medium of claim 18, wherein the information relating to conditions of travel is derived from comparing current speed with nominal speed, for appropriate ones of the trip description structures.

24. The medium of claim 18, wherein the critical time is stored as a range of times.

25. The medium of claim 18, wherein the trip data includes more than one critical time and a respective communication specification for each critical time.

* * * * *